United States Patent [19]

Bixler et al.

[11] 4,349,827

[45] Sep. 14, 1982

[54] PARABOLIC ANTENNA WITH HORN FEED ARRAY

[75] Inventors: Stephen D. Bixler, Goleta; David T. Thomas; Donald H. Archer, both of Santa Barbara, all of Calif.

[73] Assignee: Raytheon Company, Lexington, Mass.

[21] Appl. No.: 209,934

[22] Filed: Nov. 24, 1980

[51] Int. Cl.[3] ..... H01Q 13/02

[52] U.S. Cl. ..... 343/786; 343/840

[58] Field of Search ..... 343/786, 840

[56] References Cited

U.S. PATENT DOCUMENTS

| | | | |
|---|---|---|---|
| 2,415,807 | 2/1947 | Barrow et al. | 343/786 |
| 2,743,440 | 4/1956 | Riblet | 343/786 |
| 3,171,129 | 2/1965 | Nowakowski et al. | 343/786 |
| 4,012,743 | 3/1977 | Maciejewski | 343/781 R |

*Primary Examiner*—Eli Lieberman

*Attorney, Agent, or Firm*—Richard M. Sharkansky; Joseph D. Pannone

[57] ABSTRACT

A radio frequency antenna having a parabolic reflecting surface and an array of feeds disposed adjacent the focal point of the parabolic reflecting surface, such feeds providing a predetermined amplitude and phase distribution to radio frequency signals passing to such feeds, each one of such feeds passing such energy in the same propagation mode. The energy passing through each one of the feeds is reflected from the reflecting surface and combines at the radiating aperture to provide, in free space, an antenna pattern having relatively low sidelobes over a relatively wide band of frequencies. The array of feeds includes a waveguide section having opposing outer wall portions and a plurality of conductive members disposed between the opposing outer wall portions to provide, with the outer wall portions, a plurality of channels. The conductive members have first ends pivotally connected, at regularly spaced positions, to a pair of orthogonally disposed outer wall portions whereas the spacing between the second ends of the conductive members and the first mentioned pair of outer wall portions establishes the amplitude and phase distribution of the array of feeds. Such channel structure is adapted to provide the desired amplitude and phase distribution and operate with relatively large amounts of power.

2 Claims, 10 Drawing Figures

76
80
74a
74b
74c
74d
72a
72b
72c
72d
73a
73b
73c
73d
73e
62
60
38
L3
68
36
54
82a
82b
82c
82d
52
L2
6
46
48
35
L1
34
44
32
40
5
33
W
50
E
64
66
56
4

PARABOLIC ANTENNA WITH HORN FEED ARRAY

The invention herein described was made in the course of, or under, a contract or subcontract thereunder, with the Department of Defense.

BACKGROUND OF THE INVENTION

This invention relates generally to radio frequency antennas and more particularly to radio frequency antennas adapted to operate at relatively high power levels and provide antenna patterns having relatively low sidelobes over a relatively wide band of frequencies.

As is known in the art, low sidelobe antennas have a wide range of application. One such antenna suggested to provide low sidelobe antenna patterns is discussed in an article entitled "A Parabolic Cylinder Antenna With Very Low Sidelobes" by Fanti, Franchi, Kernweis and Dennett published in IEEE Transactions on Antennas and Propagation, Vol. AP-28 No. 1, January 1980 pages 53–59. Here a hog horn reflector antenna is excited by a single, large aperture feed which provides its phase and amplitude distribution for the hog horn by generating multiple modes of propagation from the single feed. Since, for the proper amplitude and phase distribution, it is necessary to generate these multiple modes of propagation and because these power multiple modes of propagation are generated at only a single frequency, or a relatively narrow band of frequencies, such antenna is not useful in applications requiring a relatively large frequency bandwidth. Further, the feed of such antenna is relatively complex to fabricate and the antenna is relatively large in size thereby further limiting its application.

SUMMARY OF THE INVENTION

In accordance with the present invention, a radio frequency antenna is provided having a parabolic reflecting surface and an array of feeds disposed adjacent the focal point of the parabolic reflecting surface, such feeds providing a predetermined amplitude and phase distribution to radio frequency signals passing through such feeds, each one of such feeds passing such energy with the same propagation mode. With such arrangement, the antenna is adapted to provide an antenna pattern having relatively low sidelobes over a relatively large band of frequencies.

In a preferred embodiment of the invention, and in accordance with a feature of the invention, the array of feeds includes a waveguide section having a pair of opposing wall portions and a plurality of spaced conductive members disposed between the pair of opposing wall portions to provide, with the pair of opposing wall portions, a plurality of channels. First ends of the conductive members are regularly spaced adjacent the focal point of the parabolic reflecting surface and second ends are spaced from each other and the pair of opposing wall portions to provide each channel with an opening sized in accordance with the desired amplitude and phase distribution to be provided to the array of feeds. Further, the phase of the signals passing through the channels is insensitive to the spacing of the second ends of the conductive members. Also, the polarization of the radio frequency energy passing between the array of feeds and the reflecting surface is unchanged. Such feed structure thereby provides a plurality of beams which combine at the radiating aperture to form a composite beam in free space having relatively low sidelobes over a relatively wide band of frequencies. Still further, the antenna is relatively simple to fabricate and, because of the channel arrangement, the antenna is adapted to operate with relatively high power levels.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Figure 1:
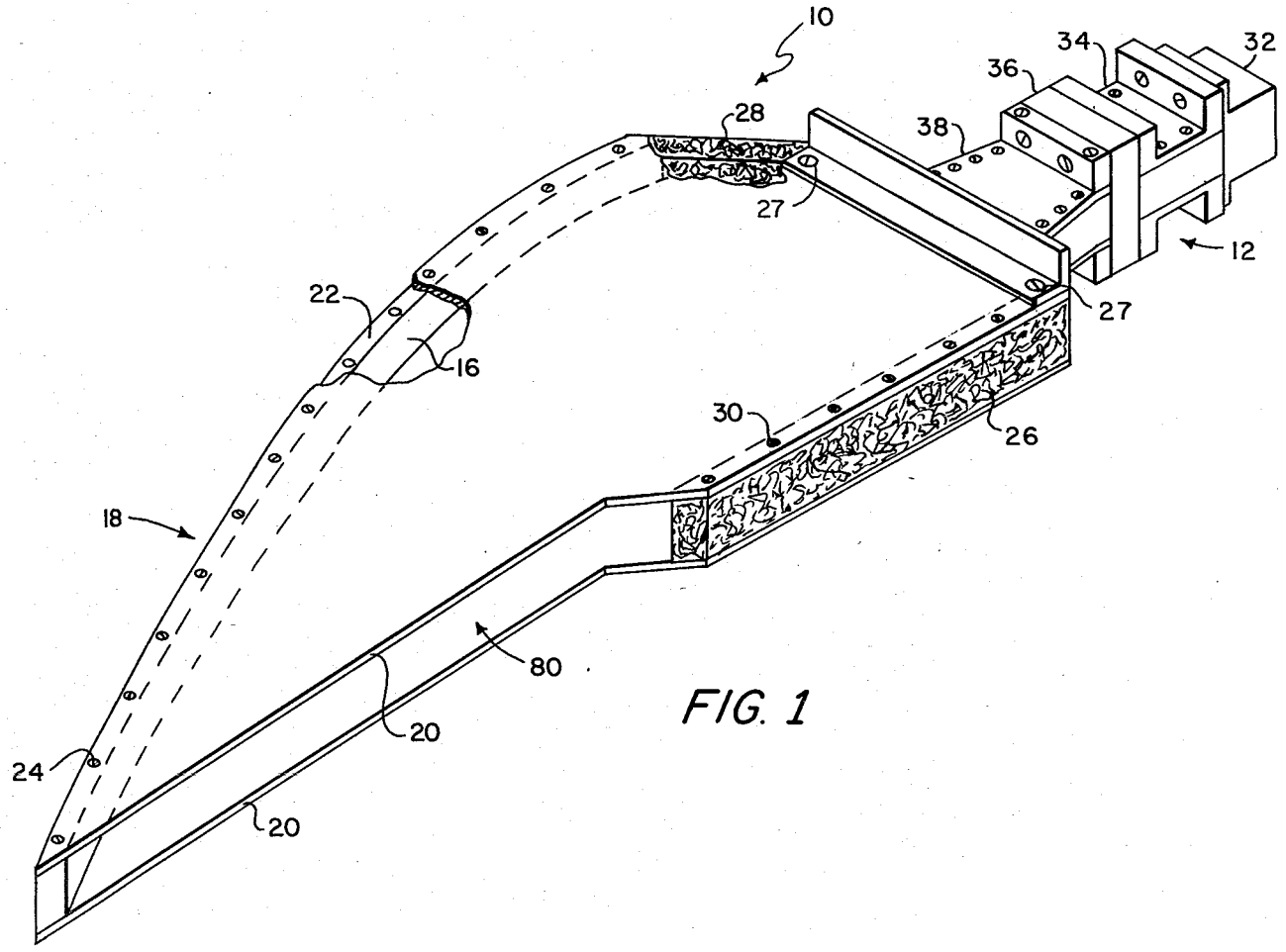
FIG. 1 is an isometric drawing, partially broken away, of an antenna according to the invention.
Figure 2:
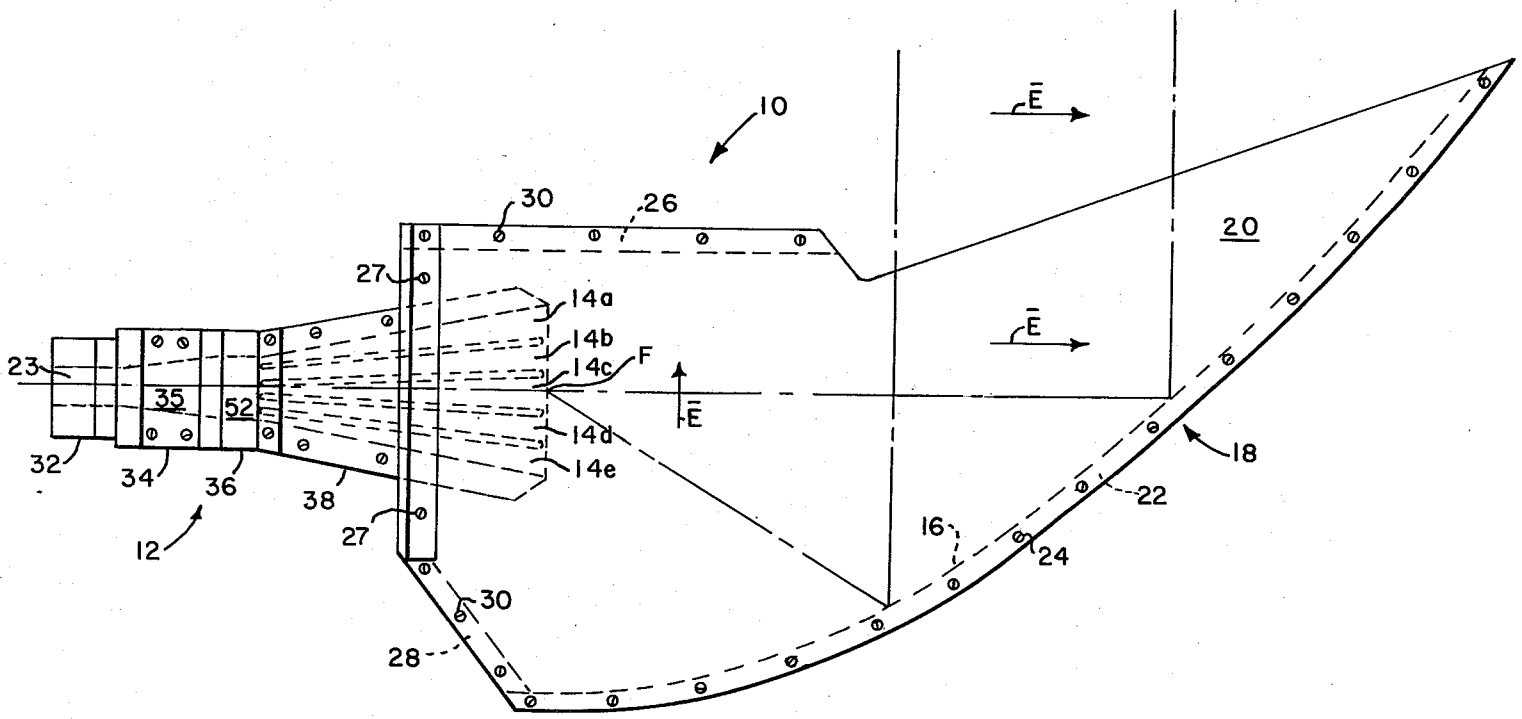
FIG. 2 is a plan view of the antenna shown in FIG. 1.

Referring now to FIGS. 1 and 2 a radio frequency antenna 10, here adapted to operate over a relatively wide band of frequencies, is shown to include a feed structure 12 having an array of feeds **14*a*–14*e* disposed adjacent the focal point F of a parabolic reflecting surface 16 of a horn portion 18 of the antenna 10**.

The horn portion 18 includes a pair of parallel plate conductive members 20 mounted to the upper and lower surface portions of a conductive member 22 having a parabolic shaped reflecting surface 16 disposed in a place orthogonal to the upper and lower surface portions of the conductive member 22. Here the parallel plate conductive member 20 are connected to the conductive member 22 of bolts 24, as shown. It is here noted that, for reasons to be discussed hereinafter, the spacing between the parallel plate conductive members 20 is greater than $\lambda/2$ but less than $\lambda$, where $\lambda$ is the wavelength of the nominal operating frequency of the antenna 10. The horn portion 18 also includes a pair of radio frequency energy absorbing materials 26, 28 disposed as shown and fastened to the pair of parallel plate conductive members 20 by bolts 30, as shown. The feed structure 12 is clamped between members 20 by bolts 27. Thus, the conductive walls of feed structure 12 are electrically and mechanically connected to members 20.

Figures 3, 4, 5, 6:
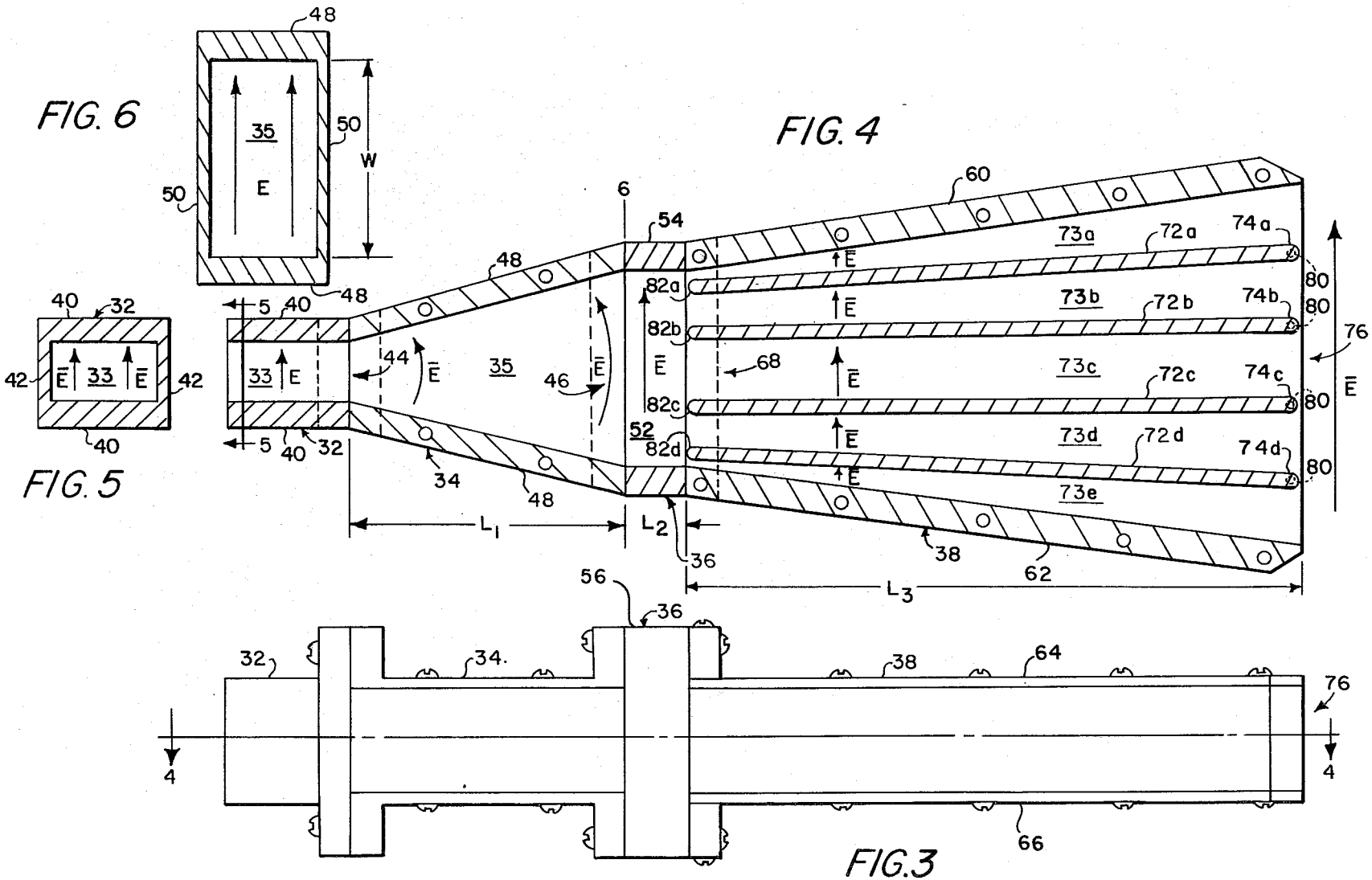
FIG. 3 is a side elevation view of a feed structure used in the antenna of FIG. 1.
FIG. 4 is a cross-sectional view of the feed structure of FIG. 3, such cross-section being taken along lines 4—4 of FIG. 3.
FIG. 5 is a cross-sectional view of the input waveguide section of the feed structure of FIG. 4, such cross-section being taken along lines 5—5 of FIG. 4.
FIG. 6 is a cross-sectional view of a planar phase section of the feed structure of FIG. 4, such cross-section being taken along lines 6—6 of FIG. 4.

Referring now to the feed structure 12, such structure 12 is shown in detail in FIGS. 3–6 to include a rectangular waveguide input section 32; a flared section 34; a planar phase section 36 and a channelized power distribution section 38. The rectangular waveguide input section 32 is here a hollow waveguide with a cavity 33 having a size designed to support radio frequency energy fed thereto by a suitable, conventional transmitter, not shown, in the $TE_{10}$ propagation mode i.e. with the electric field $\overline{E}$ of such energy disposed normal to the wide side wall portions 40 and parallel to the narrow side wall portions 42 of such rectangular waveguide section 32 as shown in FIGS. 4 and 5. The radio frequency energy fed to the rectangular waveguide section 32 is coupled to the flared section 34. Such flared section 34 has a flared, hollow cavity 35 with a relatively narrow opening 44 at the input end thereof and a relatively wider opening 46 at the output end thereof. The cavity 35 of the flared section 34 has a rectangular cross-section as shown in FIG. 6. The flared section 34 is disposed so that the electric field $\overline{E}$ in such section 34 is normal to the narrow wall portions 48 and is parallel to the wide wall portions 50, as shown in FIGS. 4 and 6. This is accomplished by gradually increasing the narrow dimension 44 of cavity 35 to the wider dimension W of the cavity 35 thereby not disturbing the $\overline{E}$ field orientation. Further, the ratio of the length $L_1$ of the section 34 to the width W of the opening 46 is here 1.4 in order to provide impedance matching.

The energy at the output of the flared section 34 is fed to the planar phase section 36. The length $L_2$ of the planar phase section 36 is here $2\lambda$. The planar phase section 36 has a hollow cavity 52, the cross-section also being shown in FIG. 6. Such cavity 52 is used to straighten the $\overline{E}$ field out from the slightly cylindrical wavefront emanating from the flared section 34. The electric field $\overline{E}$ is normal to the narrow wall portions 54 and parallel to the wide wall portions 56 (FIG. 3).

Figure 10:
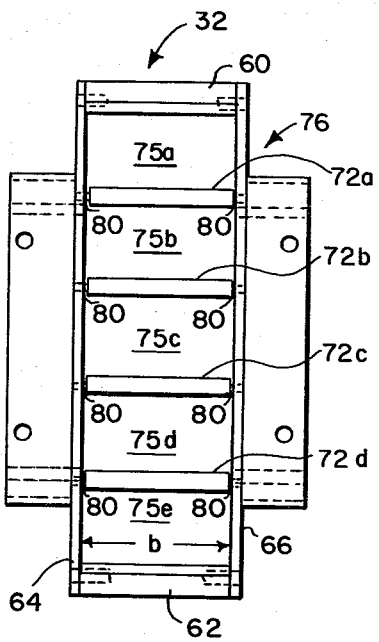
FIG. 10 is an end view of the wide end portion of the channelized power distribution section of FIG. 8.
Figure 8:
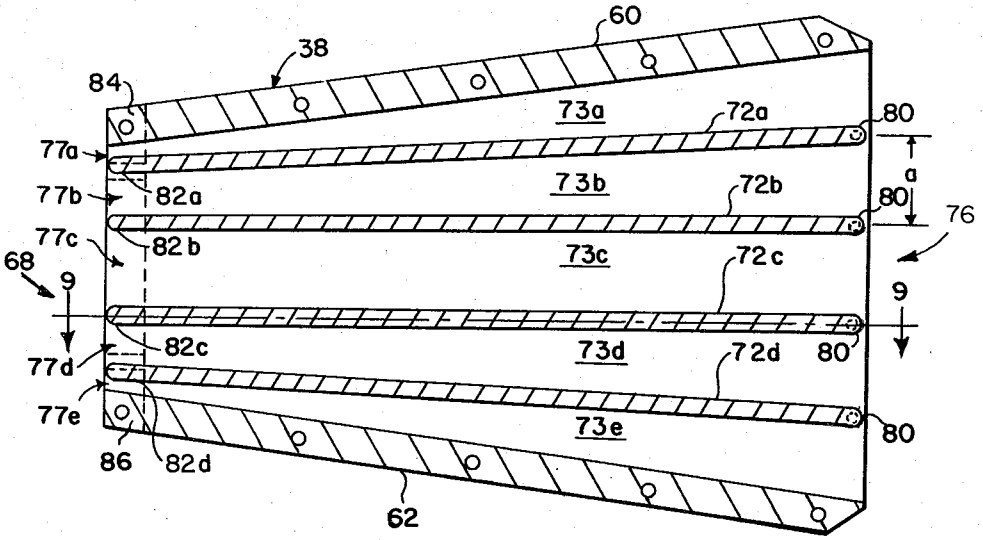
FIG. 8 is a cross-sectional view of a channelized power distribution section of FIG. 7, such cross-section being taken along lines 8—8 of FIG. 7.
Figure 9:
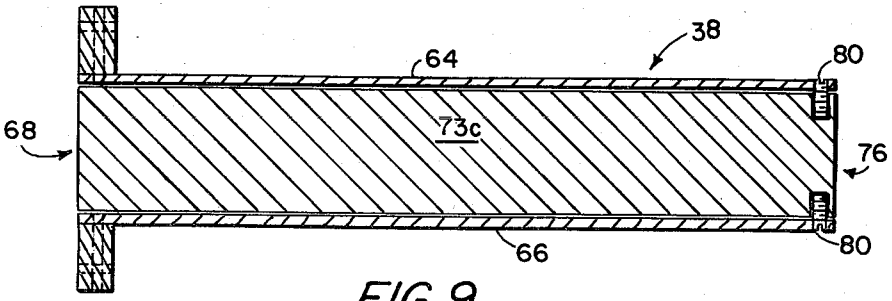
FIG. 9 is a cross-sectional view of the channelized power distribution section of FIG. 8, such cross-section being taken along lines 9—9 of FIG. 8.
Figure 7:
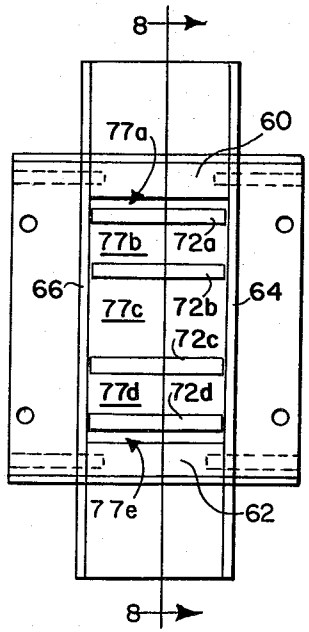
FIG. 7 is an end view of the narrow end portion of a channelized power distribution section of the feed structure of FIG. 4.

The energy at the output of the planar phase section 36 is fed to the channelized power distribution section 38, such section 38 being shown in detail in FIGS. 7–10. Such section 32 includes a pair of opposing, relatively narrow, side wall portions 60, 62 and a pair of orthogonally disposed relatively wide side wall portions 64, 66, (FIG. 9) to form a rectangular waveguide structure having flared side wall portions; the smaller opening 68 (here having a width $1.57\lambda$) being connected to the planar phase section 54 as shown in FIG. 4 and the wider opening 76 being disposed adjacent the focal point F of the parabolic reflecting surface 22 as shown in FIG. 1. Disposed between the side wall portions 60, 62 is a plurality of, here four, vane shaped conductive members *72a–72d* to provide a plurality of here 5 channels *73a–73e* as shown. The ends *74a–74d* of such members *72a–72d* disposed adjacent the wide end 76 of the section 38 are hingedly mounted to the wide wall portions 64, 66 by pins 80, as shown in FIGS. 8, 9 and 10. The pins 80 are regularly spaced along the wall portions 64, 66 to produce corresponding single beams, spaced according to the Woodward synthesis technique of beam shaping described in an article entitled "A Method of Calculating the Field Over A Plane Aperture Required to Produce a Given Polar Diagram" Journal IEE. Part III A, Vol. 93 pgs. 1554–1558 1946 as shown in FIG. 10. The thickness of each one of the conductive members *72a–72d* is the difference between the spacing of the pins 80 and $\lambda/2$. The conductive members *72a–72d* are rotated to pick off the desired amount of energy at the input opening 68. The mode of propagation is phase insensitive to the taper within each of the channels *73a–73e*. It should be noted that while a small gap is shown in FIG. 9 between the upper and lower surfaces of members *72c* and wide wall portions 64, 66 to point out that such member *72c* is rotatable, preferably the upper and lower surfaces of members *72a–72d* are actually in slight contact with surface wall portions 64, 66. Thus, the end 76 has 5 rectangular openings *75a–75e* each one having a narrow dimension "a", here $\lambda/2$ and a wide dimension "b", here $\lambda$. With such arrangement, the spacings *77a–77e* between second ends *82a–82d* and the adjacent portions 84, 86 of the side walls 60, 62 may be varied to distribute the power of the radio frequency energy fed to input opening 68 to the openings *75a–75e* in accordance with the size of such spacings *77a–77e*. It is noted that the openings *75a–75e* may be considered then as an array of feeds, each one being fed an amount of energy in accordance with the size of the opening *77a–77e* of the one of the channels feeding such feed. The length $L_3$ of such section 38 is here approximately $5\lambda$. It is also noted that the central one of the feeds or openings, here opening *75c* is disposed at the focal point of the parabolic reflecting surface 22 (FIG. 1) and such central feed *75c* contributes the most energy to the central portion of the antenna pattern. Further, it is noted that it is desirable to have the side walls of the channel *73c* for such feed *75c* (formed by members *72b, 72c*) parallel to one another. In order to obtain the desired parallel relationship of members *72b, 72c* while allowing channel *73c* to pass the greatest percentage of the energy fed to opening 68 the side walls 64, 66 are tapered as shown.

The following should be noted about the operation of the channelized power distribution section 38: First, the amplitude distribution of the power fed to such section 38 to feeds or openings *75a–75d* is controlled by the size of the opening *77a–77e* of channels *73a–73d*, and such size is controlled by the spacing between the ends *82a–82d* of the conductive members *72a–72d* and the portions 84, 86 of side wall portions 60, 62. Secondly, the spacings between the ends *82a–82d* of the conductive members *72a–72d* are easily controllable because of the pivotal mounting arrangement provided by pins 80, as shown. The spacings *77a–77e* are adjusted by observing the sidelobes of the antenna pattern and rotating the members *72a–72d* about pins 80 to obtain minimum sidelobes. Thirdly, the electric field $\overline{E}$ of the energy passing through channels *73a–73d* is normal to the members *72a–72d* as shown in FIG. 4 and hence such energy passes through each of the channels *73a–73e* in the $TE_{10}$ mode. Therefore, each of the feeds *75a–75e* passes radio frequency energy into the region between the parallel plate conductive members 20 (FIGS. 1 and 2) with the same $TE_{10}$ mode of propagation. Since then the amplitude and phase distribution of the signal coupled to the region adjacent the focal point F of the parabolic reflecting surface 22 is not dependent on providing multiple modes of preparation the antenna is able to provide low sidelobe antenna patterns over a relatively wide band of frequencies. Fourthly, it is noted that the parallel plate conductive members 20 are separated from each other by a distance greater than $\lambda/2$ and less than $\lambda$. This spacing is sufficiently large to allow the energy fed to the region 80 (FIG. 1) between the conductive member 20 by section 38 to propagate with the electric field parallel to such conductive members 20 as shown in FIG. 2. Thus, the energy propagates between the parallel plate conductive members 20 in the TE mode thereby providing the desired vertically polarized radiation from the aperture.

Having described a preferred embodiment of the invention it will now be apparent to one of skill in the art that other embodiments incorporating its concept may be used. It is believed therefore that this invention should not be restricted to the disclosed embodiment but rather should be limited only by the spirit and scope of the appended claims.

What is claimed is:

1. A feed structure having a plurality of feed ports comprising:

(a) an input waveguide section means for supporting radio frequency energy having an electric field normal to opposing parallel sidewall portions of the input waveguide section means;

(b) a flared waveguide section means having diverging sidewalls and a narrow opening disposed adjacent the input waveguide section means for supporting radio frequency energy fed thereto by the input waveguide section means, such supported energy having an arcuately shaped electric field extending across the diverging sidewalls;

(c) a second waveguide section means disposed adjacent a wide opening of the flared waveguide section means for converting the arcuately shaped electric field of energy passing from the wide opening to the second waveguide section means into a linear electric field disposed normal to parallel opposing sidewalls of the second waveguide section means; and, (d) a third waveguide section means disposed contiguous to the second waveguide section means and fed by energy passing thereto from such second waveguide section means with the linear electric field, such third waveguide section having a pair of opposing sidewalls and a plurality of spaced conductive members disposed between the pair of opposing walls to provide a plurality of channels between the second waveguide section means and the plurality of feed ports.

2. A radio frequency antenna, comprising:

(a) a parabolic reflector;

(b) an array of feed ports disposed adjacent the focal point of the parabolic reflector; and, (c) a feed structure coupled to the array of feed ports, such feed structure comprising:

(i) an input waveguide section means for supporting radio frequency energy having an electric field normal to opposing parallel sidewall portions of the input waveguide section means;

(ii) a flared waveguide section means having diverging sidewalls and having a narrow opening disposed adjacent the input waveguide section means for supporting radio frequency energy fed thereto by the input waveguide section means, such supported energy having an arcuately shaped electric field extending across the diverging sidewalls;

(iii) a second waveguide section means disposed adjacent a wide opening of the flared waveguide section means for converting the arcuately shaped electric field of energy passing from the wide opening to the second waveguide section means into a linear electric field disposed normal to parallel opposing sidewalls of the second waveguide section means; and (iv) a third waveguide section means disposed contiguous to the second waveguide section means and fed by energy passing thereto from such second waveguide section means with the linear electric field, such third waveguide section having a pair of opposing sidewalls and a plurality of spaced conductive members disposed between the pair of opposing walls to provide a plurality of channels between the second waveguide section means and the plurality of feed ports.

* * * * *